United States Patent [19]

Baier

[11] Patent Number: 4,886,103

[45] Date of Patent: Dec. 12, 1989

[54] BLIND IN A WINDOW SUPPORT

[75] Inventor: Bruce A. Baier, Pella, Iowa

[73] Assignee: Rolscreen Company, Pella, Iowa

[21] Appl. No.: 136,010

[22] Filed: Dec. 21, 1987

[51] Int. Cl.[4] ..... E06B 9/38

[52] U.S. Cl. ..... 160/178.1; 160/902; 49/64; 248/225.1

[58] Field of Search ..... 160/902, 178.1, 368.1, 160/107, 182; 49/64; 248/273, 225.1, 220.2, 489, 496, 222.2, 339; 211/115

[56] References Cited

U.S. PATENT DOCUMENTS

| | | | |
|---|---|---|---|
| 1,994,194 | 3/1935 | Fisher | 156/17 |
| 2,029,283 | 5/1937 | Etling | 160/182 |
| 3,366,159 | 1/1968 | Arnold et al. | 160/107 |
| 3,389,737 | 5/1968 | Arnold | 160/107 |
| 3,742,648 | 7/1973 | Streeter, Jr. | 49/74 |
| 4,012,023 | 3/1977 | Melanson | 248/489 |
| 4,224,974 | 9/1980 | Anderson et al. | 160/178.1 |
| 4,369,828 | 1/1983 | Tatro | 160/107 |
| 4,685,502 | 8/1987 | Spangenberg | 160/107 |

*Primary Examiner*—Blair M. Johnson

*Attorney, Agent, or Firm*—Zarley, McKee, Thomte, Voorhees & Sease

[57] ABSTRACT

A venetian blind support for a between-the-pane window blind includes an anchor clip secured to the bottom of the upper window frame rail detachably engaged by an anchor bar connected to the window blind by a rod-type hook. The support is self-centered in the window frame and the blind is self-centered as it is held by the support.

10 Claims, 2 Drawing Sheets

BLIND IN A WINDOW SUPPORT

BACKGROUND OF THE INVENTION

A blind in the window between the panes has been a very popular window product made popular by Rolscreen Company, Pella, Iowa, as disclosed in one of their representative patents 3,389,737, and sold as the Slimshade blind. The blind of this window is supported by a pair of hooks engaging the top slat of the blind, and being secured to the top rail of the window frame by screws. On the job site installation of the blind in the window is required on the part of the installer, and careful selection of the spot where the screws are inserted into the top window rail is necessary; otherwise the blind will not be centered either from side to side or front to back in the window frame and interference will result when the slats are adjusted.

It would be desirable to have a self-centering support for a between the pane blind which is easily assembled and disassembled by the installer or the user and which would operate smoothly and freely at all times.

SUMMARY OF THE INVENTION

The window blind support of this invention includes an anchor clip which is pre-sized to the window frame to be secured under the top rail of the window. An anchor bar supports the blind through rod-type hooks and engages the anchor clip in a hook-like fashion, and thus may be quickly installed in place or removed. The anchor clip has a downward extending L-shaped member which registers with an upwardly extending L-shaped member on the anchor bar, with the horizontal legs of the L-shaped members extending in opposite directions whereby the weight of the blind locks the anchor bar to the anchor clip. Shoulders on the horizontal legs of the anchor bar and anchor clip are in engagement and further limit inadvertent disassembly. An upstanding shoulder on the anchor clip engages the front face of the upper window rail and thereby locates the blind at the proper distance between the panes.

A rod-type hook includes an eye on its lower end which engages the upper slat of the blind and has an L-shaped upper end which extends through a hole in the horizontal leg of a second L-shaped portion of the anchor bar. The horizontal leg of the second L-shaped portion includes a ledge and a valley, with the L-shaped end of the rod-shaped hook being normally supported on the ledge, but free to pivot in all directions including from side to side where at times the free end of the L-shaped hook end extends over and into the valley as the blind hook pivots on the shoulder at the juncture of the ledge and the valley.

The eye on the rod-shaped hook is shaped around the axial rod of the top slat as the last step in assembling the blind to the anchor bar and the horizontal leg of the first L-shaped portion additionally functions to prevent accidental disengagement of the blind hook from the anchor clip. This is to say that at the factory, the rod-shaped blind hook is inserted into the anchor bar before it is connected to the axial rod, at which time the blind hook cannot be inadvertently disengaged from the anchor bar.

DETAILED DESCRIPTION OF THE PREFERRED EMBODIMENT

Figure 1:
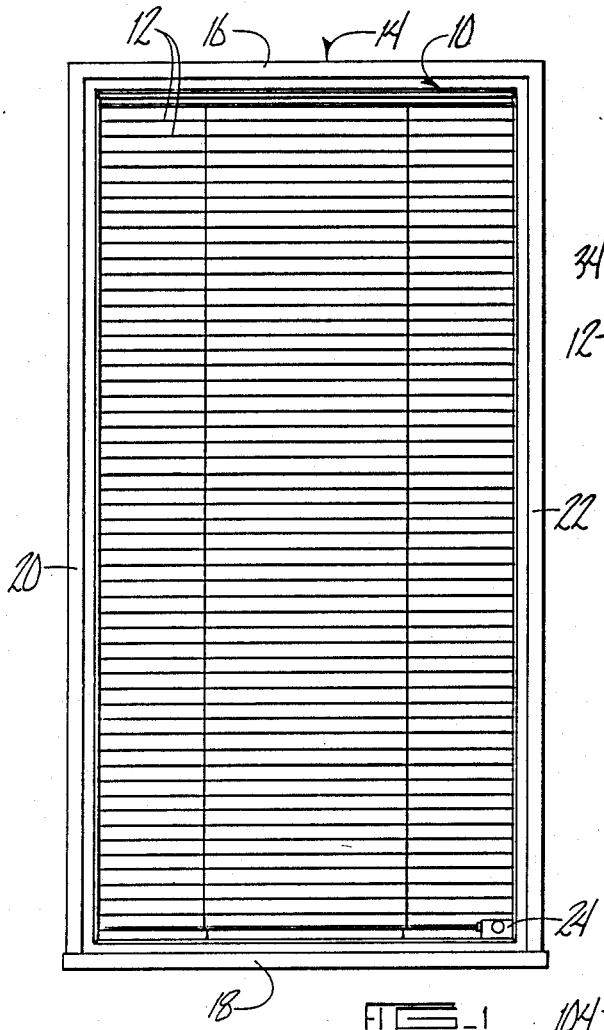
FIG. 1 is a front plan view of a between-the-pane blind supported by the support of this invention.
Figure 2:
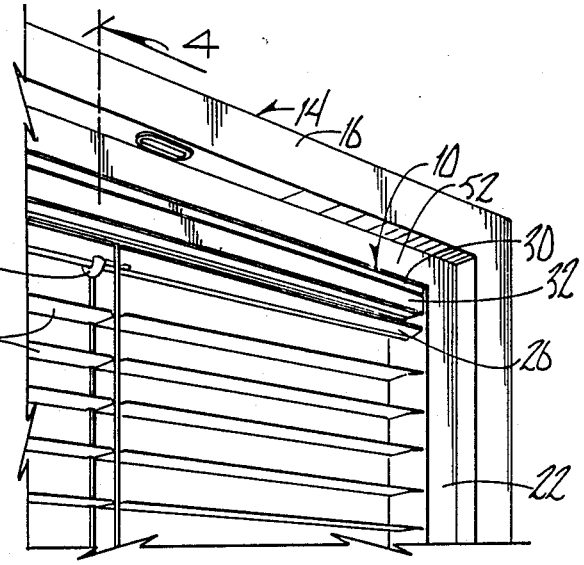
FIG. 2 is a fragmentary enlarged perspective view thereof.
Figure 2:
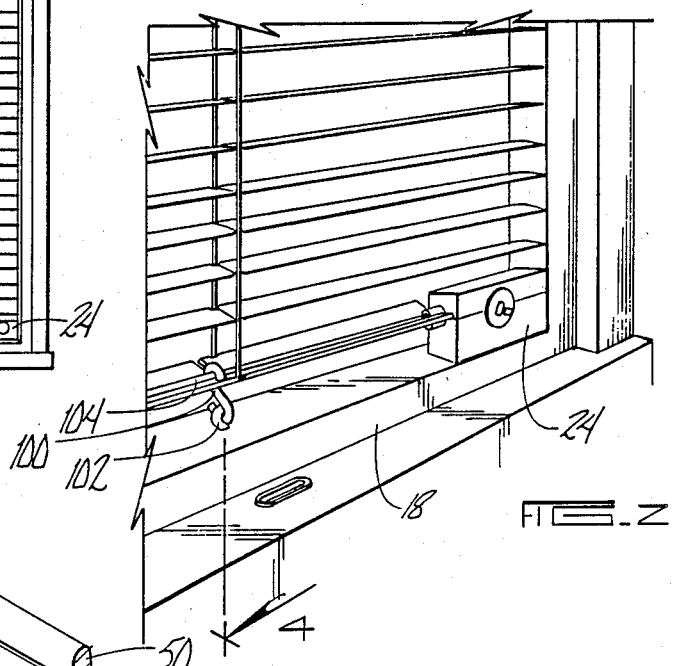
Figure 3:
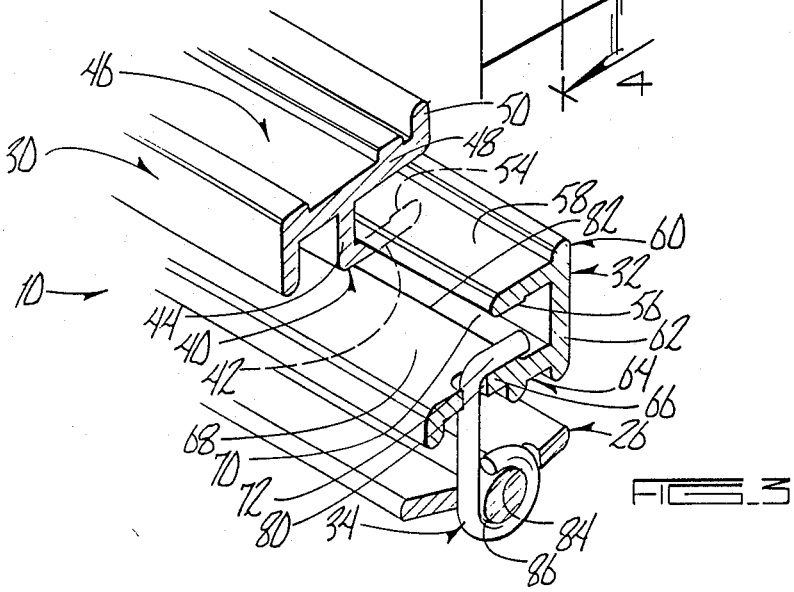
FIG. 3 is a fragmentary perspective view of the anchor clip interlocked with the anchor bar and the blind hook connected to the anchor bar.

The blind support assembly of this invention is referred to generally by the reference numeral 10 and is shown supporting a venetian blind 12 in a window frame 14 having top and bottom rails 16 and 18 and side stiles 20 and 22. A control 24 is provided for through the pane adjustment of the blind slats 26.

The support assembly 10 includes an anchor clip 30 detachably interlocked with an anchor bar 32 which supports a rod-shaped blind hook 34 connected to the top slat 26 of the blind 12.

Figures 4, 5:
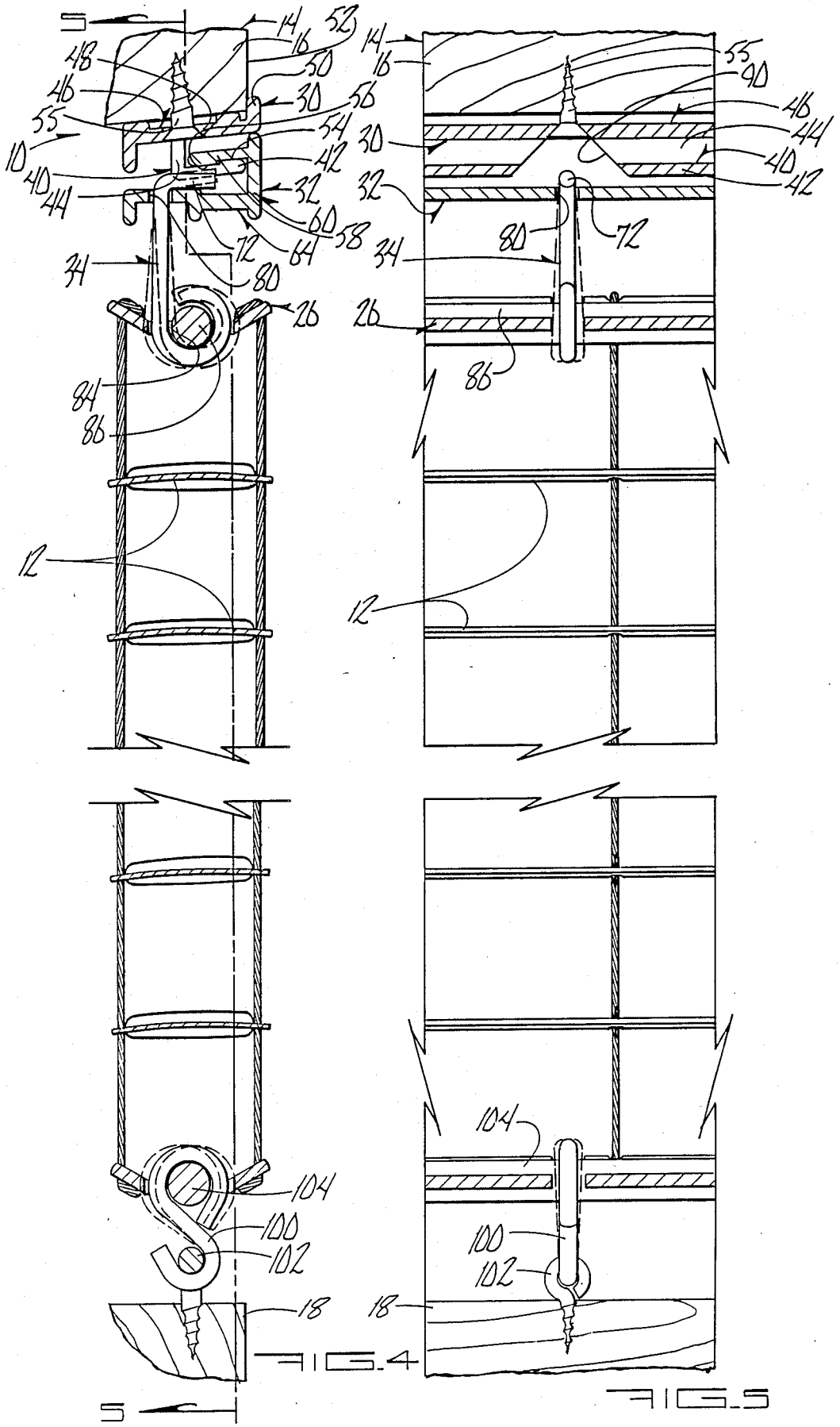
FIG. 4 is a cross-sectional view taken along line 4—4 in FIG. 2.
FIG. 5 is a cross-sectional view taken along line 5—5 in FIG. 4.

The anchor clip 30 has an L-shaped portion 40 which includes a horizontal leg 42 and a vertical leg 44. The anchor clip 30 includes a second L-shaped portion 46 having a horizontal leg 48 and a vertical leg common to the vertical leg 44 of the first L-shaped portion 40. The horizontal leg 48 includes an upstanding shoulder 50 which engages the front face 52 of the top window frame rail 16 as seen in FIG. 4 for purposes of locating and centering the blind 12 between the window panes (not shown). A screw 55 secures the anchor clip 30 to the window frame top rail 16. The anchor clip 30 and the anchor bar 32 are the same width as the window between the side stiles 20 and 22, and thus the blind 12 will be centered from side to side without interference from the side stiles. The horizontal leg 42 of the first L-shaped portion 40 extends towards the front side of the window and includes a shoulder 54 which interlocks with a shoulder 56 on a horizontal leg 58 of a first L-shaped portion 60. L-shaped portion 60 includes a vertical leg 62 which is common to the second L-shaped portion 64 having a horizontal leg 66.

The second horizontal leg 66 includes a ledge 68 which merges into a valley 70 adjacent the vertical leg 62. The rod-shaped blind hook 34 has an L-shaped end 72 which rests on the ledge 68 and extends over the valley 70 such that the hook 34 may pivot freely in the hole 80 to allow the blind 12 to self-center after temporary disalignment has occurred, such as during storage or assembly and disassembly of the blind in the window. The juncture at the ledge 68 and the valley 70 forms a shoulder 82 which functions as the pivot point for the hook 34 at times as it moves from side to side as seen in FIG. 4 by the dash line representations of the hook.

The hook 34 also includes an eye 84 which is connected to the axial rod 86 of the top slat 26, thus allowing the blind 12 to float freely.

It is thus seen in assembly of the blind to the anchor bar 32 that the rod-shaped hook 34 is first threaded through the hole 80 and then the eye 84 is formed around the axial rod 86, whereby the blind is now locked onto the anchor bar 32 but is allowed to freely float therefrom when installed in the window frame 14. The horizontal leg 58 of the anchor bar 32 limits the upward travel of the blind clip 34.

On the job site, the anchor clip 30 is placed in the window frame 14 under the top rail 16 with the upstanding shoulder 50 engaging the front face 52 of the rail 16. The screws 54 hold the clip 30 in place. Access to the screw head is possible through an opening 90 in the horizontal leg 42 as seen in FIG. 5. The lower end of the blind 12 is secured to the bottom window rail 18 by an S-shaped hook 100 engaging a screw 102 having an eye. The upper end of the S-shaped hook 100 engages the axial rod 104 of the bottom slat 26.

What is claimed is:

1. A blind in window support, comprising:

a blind support having a horizontally disposed leg including an upstanding ledge and a vertical opening extending through said ledge, and a blind hook having an L-shaped rod portion on its upper end extending through said opening with a horizontal leg being pivotally supported on said ledge.

2. The structure of claim 1 wherein said ledge on one side merges into a valley.

3. The structure of claim 2 wherein said horizontal leg of said blind hook extends beyond said ledge and over said valley whereby pivoting of said blind hook is freely permitted in the vvertical plane of said blind hook L-shaped portion with the free end of said horizontal leg at times extending downwardly toward said valley while a shoulder at the juncture of said ledge with said valley becomes a pivot point for said blind hook.

4. The structure of claim 3 wherein an eye is provided on the lower end of said blind hook adapted to pivotally engage the axial rod of the top blind slat.

5. The structure of claim 1 wherein said blind support includes an upstanding shoulder along one side adapted to engage a vertical side of a top window rail to function as a stop to locate said blind in said window relative to the window pane.

6. A blind in window support, comprising:

a blind support having an anchor clip adapted to be secured to a window top rail, an anchor bar adapted to be secured to the top end of a blind, said anchor clip having a downwardly extending hook means and said anchor bar having an upwardly extending hook means detachably engaging said downwardly engaging hook means, said downwardly and upwardly extending hook means each including L-shaped portions having substantially horizontally extending legs in registry, the L-shaped portion of said upwardly extending hook means on said anchor bar being one of two L-shaped portions with the second L-shaped portion extending downwardly and having a horizontal leg adapted to be secured to a blind, and the vertical legs of the first and second L-shaped portions being interconnected, said horizontal leg on said second L-shaped portion including a hole adapted to receive a rod-shaped blind hook, said horizontal leg of said second L-shaped portion being further defined as including a ledge, and said hole extending through said ledge, said ledge terminating in a valley on one side, and said blind hook including an L-shaped portion on its upper end which extending through said hole and the horizontal leg of said rod-shaped L-shaped portion being supported on said ledge.

7. The structure of claim 6 wherein said horizontal leg of said blind hook extends beyond said ledge and over said valley whereby pivoting of said blind hook is freely permitted in the vertical plane of said blind hook L-shaped portion with the free end of said horizontal leg at times extending downwardly towards said valley while a shoulder at the juncture of said ledge with said valley becomes a pivot point for said blind hook.

8. The structure of claim 7 wherein an eye is provided on the lower end of said blind hook adapted to pivotally engage the axial rod of the top blind slot.

9. A blind support, comprising:

a blind;

a blind support having an anchor clip adapted to be secured to a window top rail, an anchor bar adapted to be secured to the top end of a blind, said anchor clip having a downwardly extending hook means and said anchor bar having an upwardly extending hook means detachably engaging said downwardly engaging hook means, said downwardly and upwardly extending hook means each including L-shaped portions having substantially horizontally extending legs in registry, and said horizontally extending legs in registry are further defined by said leg of said anchor clip sloping upwardly and said leg of said anchor bar sloping downwardly said anchor clip and anchor bar legs each having cooperating interlocking shoulders, whereby the hooking action between said anchor clip and said anchor bar increases as the weight on said anchor bar increases.

10. A blind support, comprising:

a blind;

a blind support having an anchor clip adapted to be secured to a window top rail, an anchor bar adapted to be secured to the top end of a blind, said anchor clip having a downwardly extending hook means and said anchor bar having an upwardly ending hook means detachably engaging said downwardly engaging hook means, said downwardly and upwardly extending hook means each including L-shaped portions having substantially horizontally extending legs in registry, and said horizontally extending legs in registry are further defined by said leg of said anchor clip being cantilevered and extending in one direction and the leg of said anchor bar being cantilevered and extending in the opposite direction and being disposed on top of said leg of said anchor clip, said anchor clip and anchor bar legs each having cooperating interlocking shoulders, whereby said anchor bar is totally supportably engaged and disengaged from said anchor clip by moving said anchor bar upwardly and laterally horizontally towards and away from said anchor clip respectively.

* * * * *